US006883610B2

(12) United States Patent
Depiak

(10) Patent No.: US 6,883,610 B2
(45) Date of Patent: Apr. 26, 2005

(54) STRADDLE PACKER SYSTEMS

(76) Inventor: Karol Depiak, 16 Stratton Hill Rise SW, Calgary (CA), T2H 1X7

( * ) Notice: Subject to any disclaimer, the term of this patent is extended or adjusted under 35 U.S.C. 154(b) by 240 days.

(21) Appl. No.: 10/021,085

(22) Filed: Dec. 19, 2001

(65) Prior Publication Data

US 2002/0162660 A1 Nov. 7, 2002

Related U.S. Application Data

(60) Provisional application No. 60/256,457, filed on Dec. 20, 2000.

(51) Int. Cl.[7] ..... E21B 43/26

(52) U.S. Cl. ..... 166/308; 166/191; 166/387; 166/177.5; 166/53

(58) Field of Search ..... 166/308, 53, 387, 166/191, 250.1, 177.5

(56) References Cited

U.S. PATENT DOCUMENTS 2,738,014 A 3/1956 Lynes
2,776,014 A * 1/1957 Lee et al. ..... 166/177.5
3,382,930 A * 5/1968 Ribb et al. ..... 166/242.3
5,000,265 A 3/1991 Pleasants et al.
5,277,253 A 1/1994 Giroux et al.
5,295,393 A * 3/1994 Thiercelin ..... 73/152.51
5,501,281 A 3/1996 White et al.
5,782,306 A 7/1998 Serafin

* cited by examiner

*Primary Examiner*—David Bagnell
*Assistant Examiner*—Giovanna Collins

(57) ABSTRACT

The present invention relates to straddle packer systems and methods of using them for downhole isolation of zones for fracturing treatment. More specifically, the system includes upper and lower seal systems having resiliently flexible sealing elements hydraulically and operatively connected to one another which are responsive to an increase in hydraulic pressure for setting the sealing elements at a first hydraulic pressure threshold. Additionally, the system includes a control system hydraulically and operatively connected between the upper and lower packer systems which is responsive to an increase in hydraulic pressure at a second hydraulic pressure threshold higher for activating a pressure switch system within the control system for opening at least one frac valve in the control system.

16 Claims, 12 Drawing Sheets

HIGH PRESSURE CHANNEL
LOW PRESSURE CHANNEL

HIGH PRESSURE PORTS

HIGH PRESSURE CHANNEL
LOW PRESSURE CHANNEL

HIGH PRESSURE PORTS

1- MANDRELS
2- SPACER
3- TOP SHEAR RING
4- CASING ADAPTER
5- PISTON ADAPTER
6- PISTON BARREL
7- PISTON
8- BARREL ADAPTER ASSEMBLY
9- PROTECTOR SLEEVE
10- FRAC SUB ASSEMBLY
11- POPPET ASSEMBLY
12- PRESSURE SWITCH HOUSING
14- SWITCH RETURN SPRING
15- PRESSURE SWITCH/PRESSURE SWITCH ASSEMBLY
20- BOTTOM SHEAR RING
21- P S. UPPER PISTON
24- P S LOWER PISTON
26- RUBBER ELEMENT
27- SHEAR RING FILTER
28- MANDREL FILTER
29- SPRING
30- C.T. INTERNAL VOLUME
31- WELL BORE ANNULUS
32- LOW PRESSURE PISTON CHANNEL
33- HIGH PRESSURE PISTON PORT
34- HIGH PRESSURE PISTON CHAMBER
35- LOW PRESSURE PISTON CHAMBER
36- CIRCULATION NOZZLE
37- POPPET SEAT
38- FRAC PORT
40- LOW PRESSURE FRAC VALVE CHANNEL
41- HIGH PRESSURE FRAC VALVE CHANNEL
42- HIGH PRESSURE PISTON
43- HIGH PRESSURE FRAC VALVE CHAMBER
46- LOW PRESSURE PISTON
47- PRESSURE CHAMBER
49- P.S. HIGH PRESSURE CHANNEL
50- HIGH PRESSURE P.S. CHAMBER #1
51- P.S. UPPER PISTON PORT
52- HIGH PRESSURE P.S. CHAMBER #2
53- P.S. LOWER PISTON PORT
54- P.S. VENT
56- CHECK VALVE ASSEMBLY
100- STRADDLE PACKER SYSTEM
101- UPPER PACKER ASSEMBLY
102- CONTROL ASSEMBLY
103- BLAST JOINT
104- LOWER PACKER ASSEMBLY
105- POWER SHEAR ASSEMBLY
200- COILED TUBING
201- ISOLATED ZONE

FIG. 9

STRADDLE PACKER SYSTEMS

FIELD OF THE INVENTION

The present application claims the benefit of priority to U.S. Ser. No. 60/256,457, filed Dec. 20, 2000, which is hereby incorporated by reference.

BACKGROUND OF THE INVENTION

Downhole isolation of zones within a wellbore for fracturing treatment is well known. While the isolation of zones of interest for high pressure fracturing is an effective production methodology, there is a continuing need to improve the reliability and efficiency of tools used in the isolation and fracturing processes.

Current straddle packer designs are based primarily on cup technology which has many disadvantages. For example, straddle packers of this design are limited with respect to the depth and pressure conditions that they can operate under. In addition, they are not suitable for highly deviated or horizontal wells with complex profiles.

Furthermore, current designs of straddle packers tend to be primarily mechanical or a combination of mechanical/hydraulic. Many designs are mechanical interlocking slips or dropped balls to synchronize and control packer operation. These types of devices however, are prone to contamination within the operating environment from contaminants such as sand which can enter the devices and cause the devices to fail.

Further still, current designs are prone to problems from operator error where manipulation of the tool and tubing string may result in improper setting, operation or release of the tool white downhole.

Further yet, the retrievablility of packer tools is also particularly important. As is known the cost of both the tool and/or the time associated with attempting to retrieve a jammed tool are significant. As a result, there is a continuing need to design tools that minimize the risk of the tool becoming jammed downhole which will result in operator expense from lost time or a lost tool Furthermore, in that traditional devices generally have only one method of retrieval, there is also a need for tools which have a variety of retrieval methods such that if one method of retrieval fails, other retrieval methods are possible.

It is therefore an object of the present invention to provide a straddle isolation packer that obviates or mitigates the above disadvantages.

SUMMARY OF THE INVENTION

According to the invention, a straddle packer system (SPS) includes a pair of hydraulic-set packers. Simultaneous setting and releasing of these packers is controlled by a single hydraulic setting mechanism. This assembly, with various lengths of straddle tubing between the pair of hydraulic set packers, is used to straddle sections of well bore perforations to be treated. The SPS is connected to the coiled tubing and run to the desired depth. The packer is set and sealed automatically by increasing the pumping pressure in the coiled tubing, which above a threshold value, allows fracturing treatments to be performed. Setting, releasing the packer, and circulating/reverse-circulating across the packer is controlled by the operator by changing the pressure/pumping rate inside the coiled tubing. To ensure smooth and reliable operation of the packer in the well during fracturing or any other type of operation, strategically placed filters and wiper seals are used. The filters and wiper seals prevent contamination of the tool with sand or any other fine solids that are pumped through the coiled tubing or present in the well bore during the treatment. Technology used in the design of the straddle packer can be further developed into the design of the through-tubing packer.

Various features and advantages of the invention include:

1. The SPS is ideally suited for multi zone coiled tubing fracturing but is also suited for any other type of operation requiring zonal isolation or segregated isolation between two points of any bore.
2. The SPS allows safe and economical single trip multi zone coiled tubing fracturing in the demanding fracturing operations environment. Also, in contrast to present cup designs of the straddle packers, the SPS does not block circulation across the sealing elements when it is not set.
3. The SPS is suitable for use at differential pressures up to 20,000 psi at temperatures up to 800° F. in vertical, highly deviated and horizontal wells or those with complex profiles.
4. The SPS provides setting and releasing without the necessity of mandrel movement, but rather automatic setting and releasing controlled by the coiled tubing internal pressure.
5. The SPS designed specifically for fracturing with coiled tubing but is not limited to use with coiled tubing. It may be operable even with a limited amount of hydraulic leaking in the SPS hydraulics.
6. The SPS provides a better seal with an increase of the treatment pressure.
7. The SPS includes frac ports designed to minimize erosion damage to the well bore casing wall and to the frac sub caused by treatment fluid at high pumping rates. The frac ports are hydrodynamically streamlined along the long axis of the packer and generally direct fluid in a downhole direction. This reduces turbulence of the treatment fluid at the frac port and erosion is minimized by not requiring treatment fluids to change direction through 180 degrees as in past systems. Also, hydrodynamic streamlining of the frac ports minimizes the pumping energy losses to the fluid, which results in more efficient and safer fracturing operations.
8. The SPS can be applied to but not limited to various sizes of inner bore well diameters including for 2⅜"×4½", 2⅞"×5½", 3½"×7", and 4½"×9⅝" through tubing/casing applications. The design of the SPS can be modified to meet the requirements of the packer for through tubing applications. This technology be applied to but not limited to casing sizes for 4½", 5½", 6⅝, 7" and 9".
9. The SPS can straddle considerable lengths of well bore because the fluid is discharged at the up-hole seal section. In this configuration the hydrostatic pressure assists by pushing the fluid into perforations, which result in efficient fracturing treatments.

More specifically and in accordance with the invention, a straddle packer and fracturing treatment system is provided comprising:

upper and lower seal systems having resiliently flexible sealing elements hydraulically and operatively connected to one another, the upper and lower packing systems responsive to an increase in hydraulic pressure for setting the sealing elements at a first hydraulic pressure threshold;

a control system hydraulically and operatively connected between the upper and lower packer systems, the control system responsive to an increase in hydraulic pressure at a second hydraulic pressure threshold higher than the first hydraulic pressure for activating a pressure switch system within the control system for opening at least one frac valve in the control system.

In further embodiments, the pressure switch system is responsive to a third hydraulic pressure threshold between the first and second hydraulic pressure thresholds for closing the at least one frac valve. The first hydraulic pressure threshold is preferably 1000–1200 psi, the second hydraulic pressure threshold is preferably 1700–2500 psi, and the third hydraulic pressure threshold is preferably 1200–1500 psi.

In a still further embodiment, the control system and pressure switch system include:

a pressure switch operatively retained in the control system, the pressure switch having a first high pressure piston and chamber and a second low pressure piston and chamber, the pressure switch operable between a closed and an open position;

a pressure switch return spring for biasing the pressure switch to a closed position when the hydraulic pressure is below the second hydraulic pressure threshold;

a return spring for biasing the at least one frac valve to a closed position when the hydraulic pressure is below the second hydraulic pressure threshold and the pressure switch is in the closed position;

wherein hydraulic pressure at the second hydraulic pressure threshold acting on the first high pressure piston causes the pressure switch to move to the open position.

In a still further embodiment, the pressure switch system further comprises a hydraulic channel operatively connected between the first high pressure piston chamber and second low pressure piston chamber, wherein the hydraulic channel is open when the pressure switch is in the open position and/or the control system includes circulation nozzles in fluid communication between the interior and exterior of the system for allowing a circulating fluid to be run from the interior to the exterior of the systems. In one embodiment, the control system further comprises a check valve assembly in fluid communication with the at least on frac valve, the check valve assembly for enabling a circulating fluid to flow from the exterior to the interior of the system while bypassing the circulation nozzles.

In yet another embodiment the system includes a power shear assembly operatively and hydraulically connected to the lower seal system for hydraulically pressurizing the lower seal element from the underside of the lower seal system.

In a further and more specific embodiment, the first high pressure piston chamber further comprises a second high volume piston chamber and wherein the first high pressure piston chamber is in hydraulic communication with the second high volume piston chamber when the pressure switch is in the closed position and wherein the second high volume piston chamber is vented to the wellbore above the first sealing element when the pressure switch is in the open position and wherein the first high pressure piston chamber and second high volume piston chamber are sealed from one another when the pressure switch is in the open position.

In yet another embodiment, the invention provides a method of treating a formation with a straddle packer through a wellbore comprising the steps of:

a) lowering a system as in claim 1 downhole to a zone of interest;

b) increasing pumping pressure to the system to the first hydraulic pressure threshold to seal the upper and lower seal assemblies against the well bore;

c) increasing the pumping pressure to the system to the second hydraulic pressure threshold to open the at least one frac port; and d) increasing the pumping pressure to the system above the second hydraulic pressure threshold to apply a fracturing treatment to the zone of interest.

BRIEF DESCRIPTION OF THE DRAWINGS

The invention will now be described more fully with reference to the accompanying drawings in which:

FIG. 9 is a legend identifying reference characters used in FIGS. 1 through 8.

DETAILED DESCRIPTION OF THE INVENTION

Figure 1:
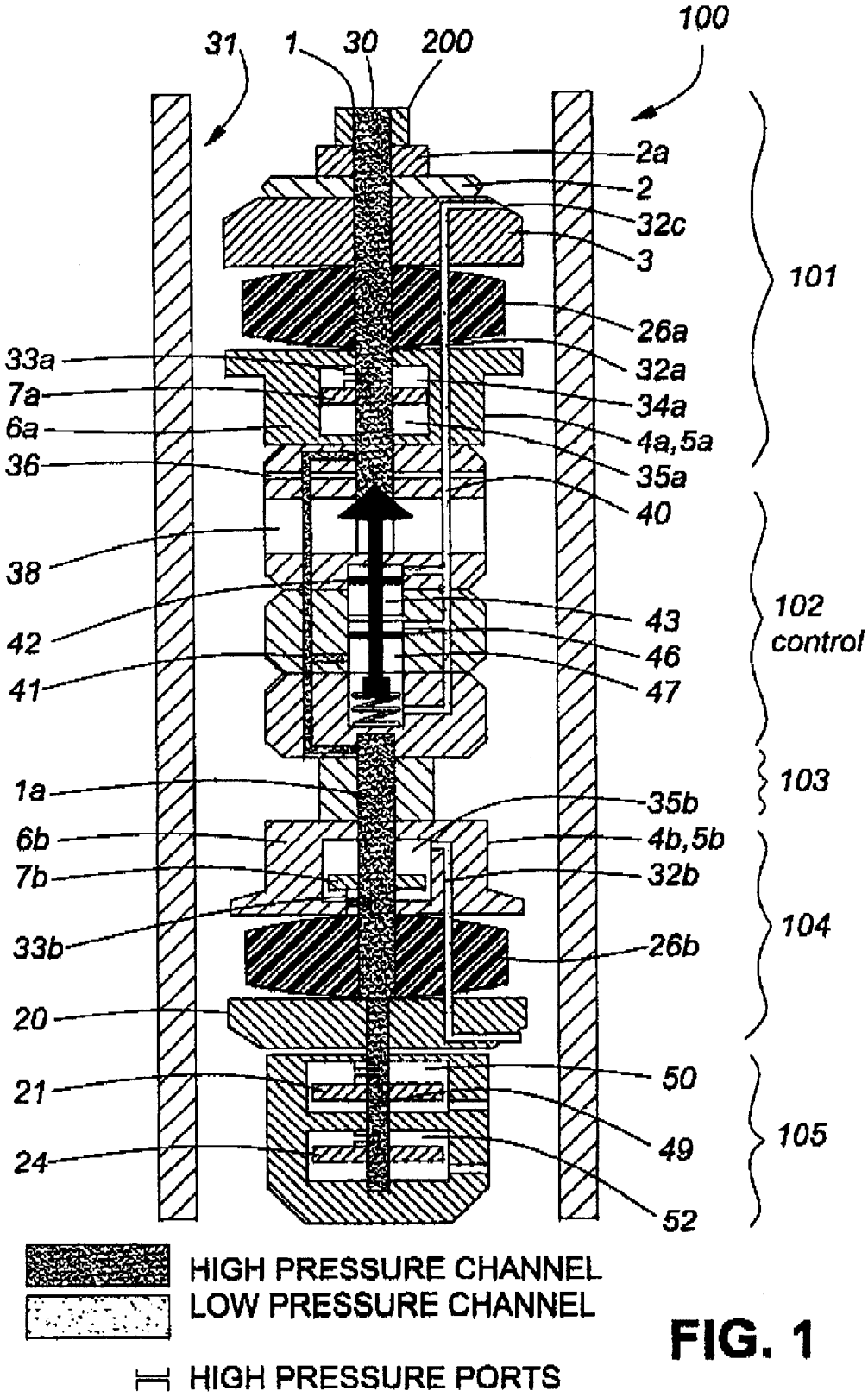
FIG. 1 is a schematic diagram of the straddle packer system in accordance with the invention.

With reference to the Figures, the straddle packer system (SPS) 100 includes five main sub-assemblies including an upper packer assembly 101, a control assembly 102, a blast joint 103, a lower packer assembly 104 and a power shear assembly 105.

Figure 3:
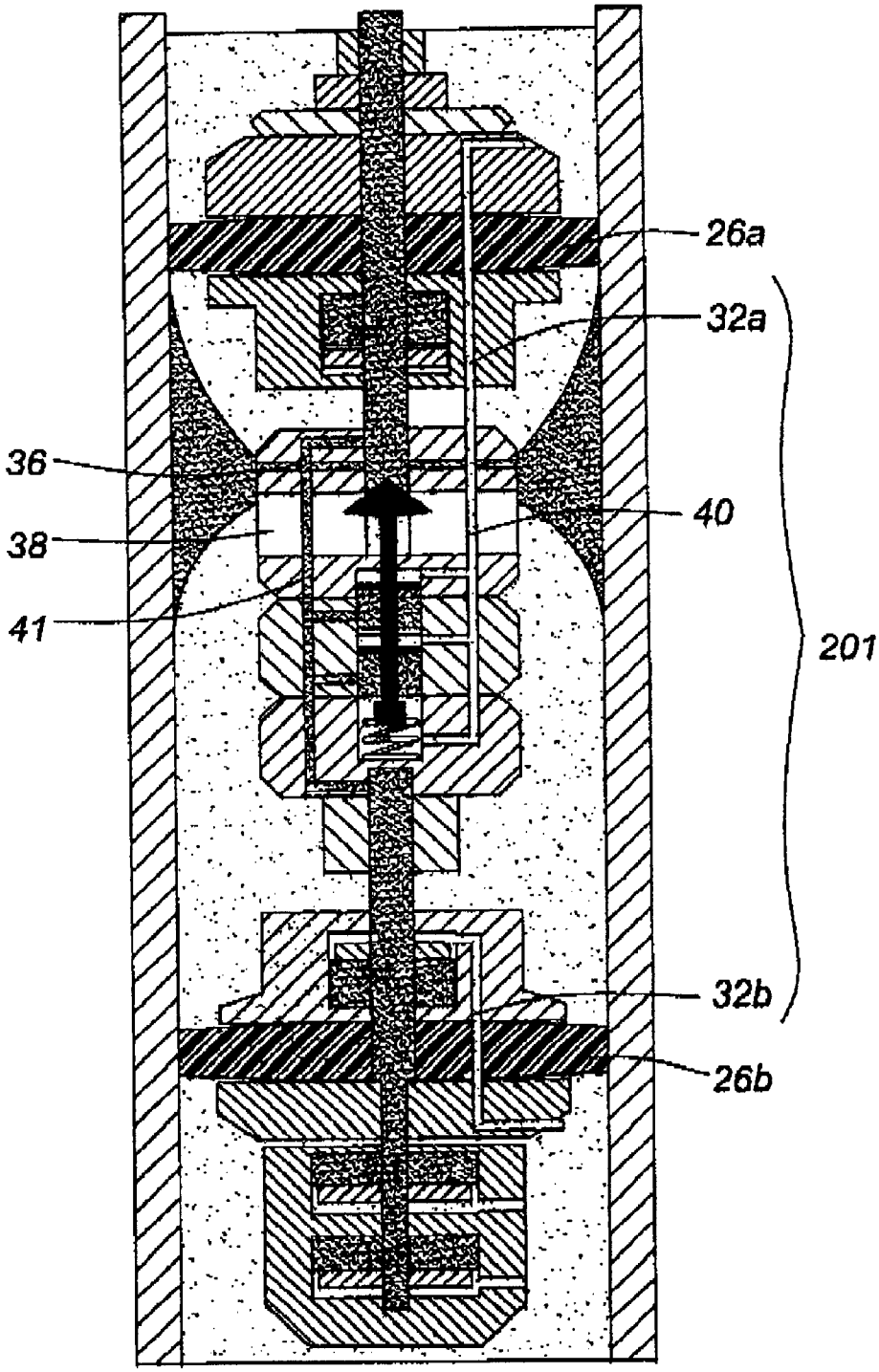
FIG. 3 is a schematic diagram, of the straddle packer system in the setting phase in accordance with the invention.
Figure 4:
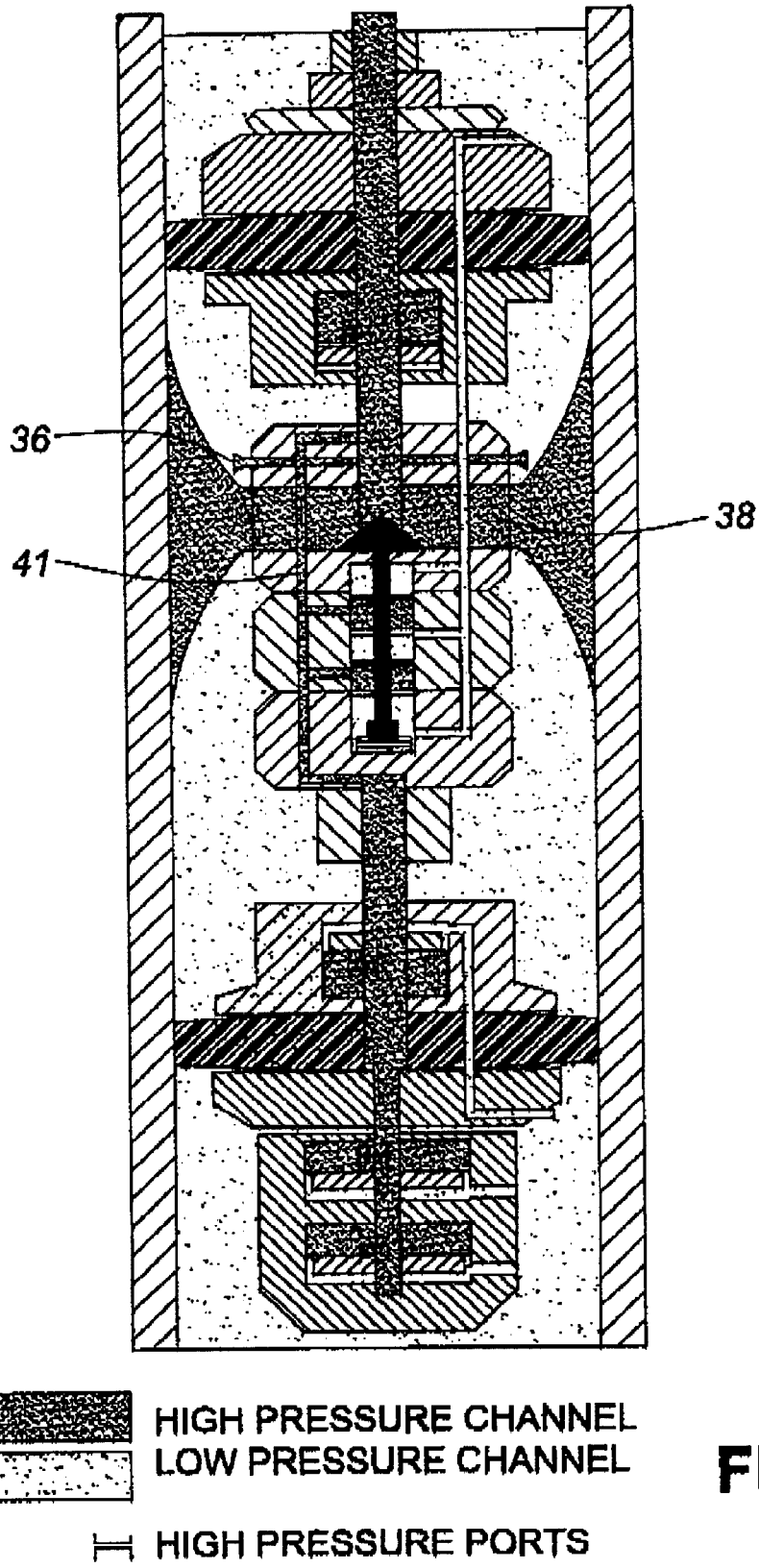
FIG. 4 is a schematic diagram of the straddle packer system in the treatment phase in accordance with the invention.
Figure 5:
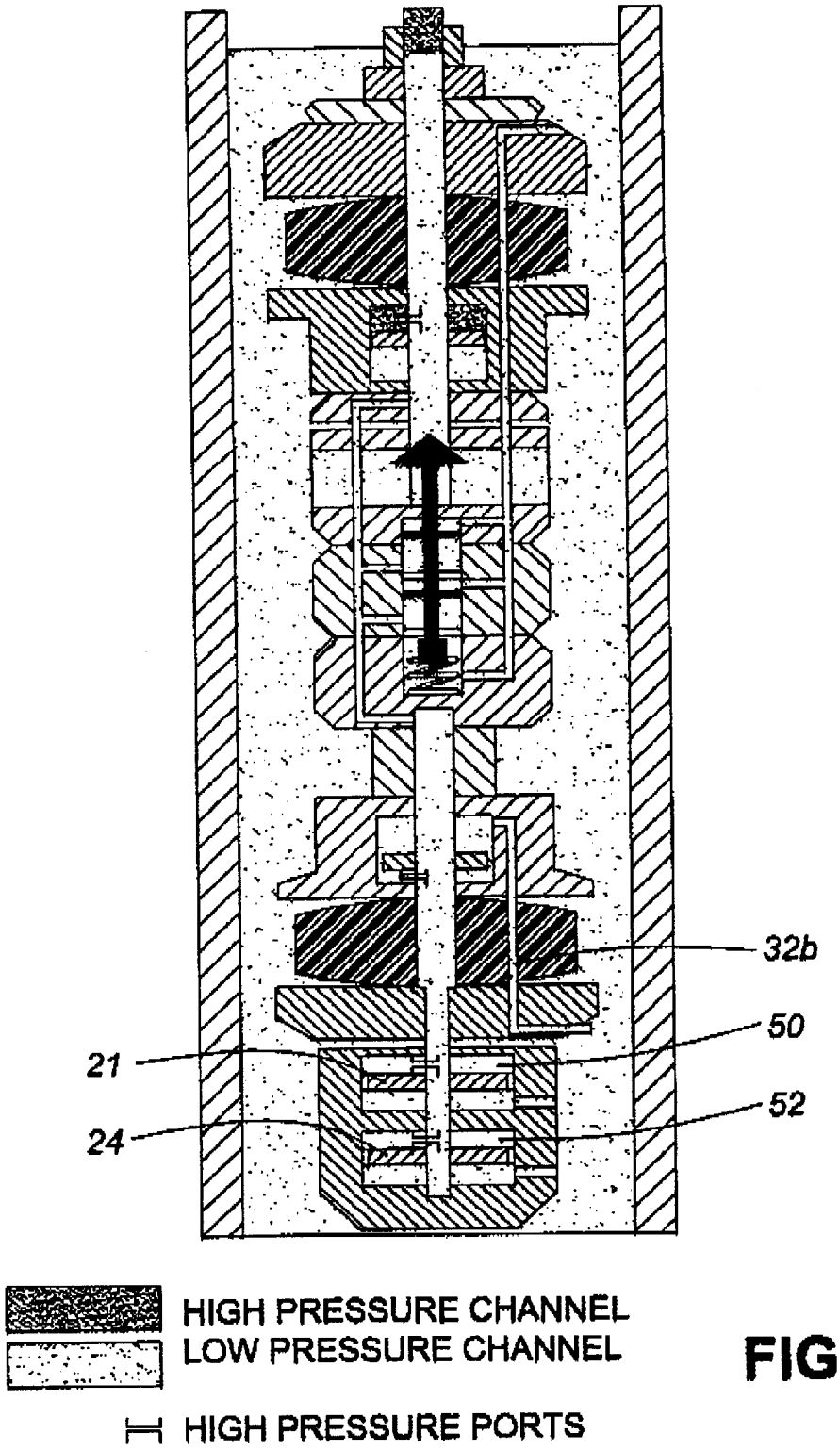
FIG. 5 is a schematic diagram of the straddle packer system in the releasing phase in accordance with the invention.

As an overview, the SPS allows a zone of interest to be isolated for fracturing treatment. Initially, the SPS is connected to a coiled tubing string and pushed downhole. At the zone of interest, the upper packer assembly 101 and lower packer assembly 104 are set against the well bore or well bore casing to seal the zone of interest by increasing the pumping pressure of fluid circulating through the coiled tubing 200, SPS and isolated zone 201 (FIG. 3). After sealing the zone of interest, a further increase in the pumping pressure opens a valve in the control assembly 102 allowing a fracturing treatment to be applied to the isolated zone 201 (FIG. 4). After treatment the pumping pressure is relaxed causing the valve to close first followed by the upper and lower packer assemblies thereby allowing the SPS to be removed from the well or moved to a different zone of the well (FIG. 5). The blast joint assembly 103 is a section of the SPS of variable length allowing zones of different lengths to be sealed and treated.

The design and operation of the SPS is described in greater detail below:

Upper Packer Assembly 101 and Lower Packer Assembly 104

Figure 6A:
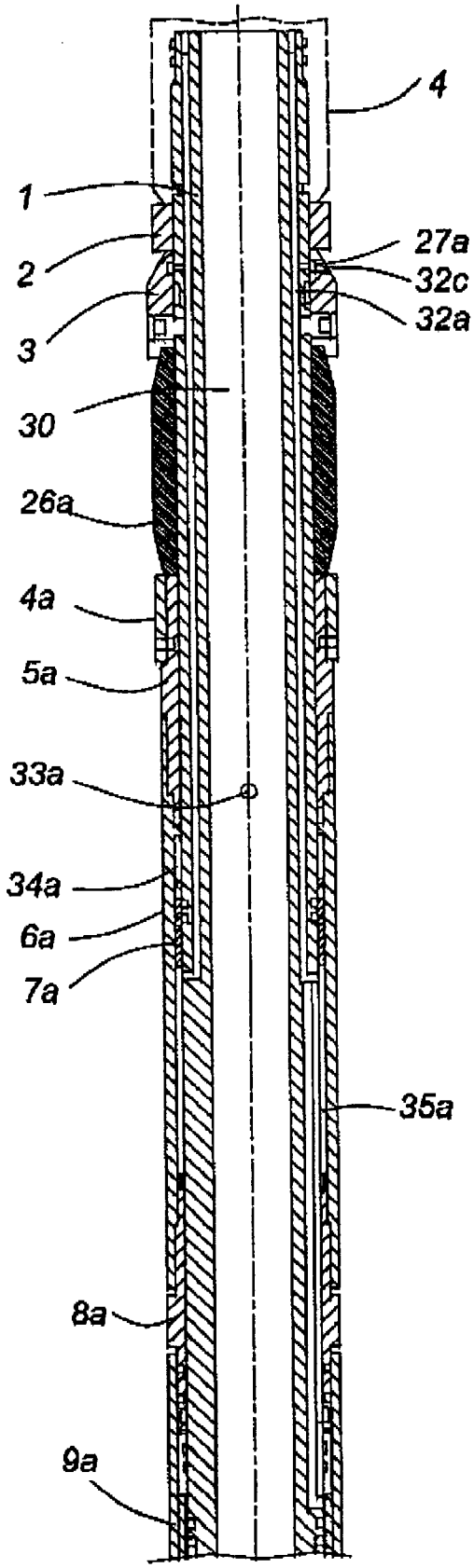
FIGS. 6A and 6B are a detailed assembly drawing of the upper packer assembly and control assembly, disposed on the upper mandrel of the tool.
Figure 6B:
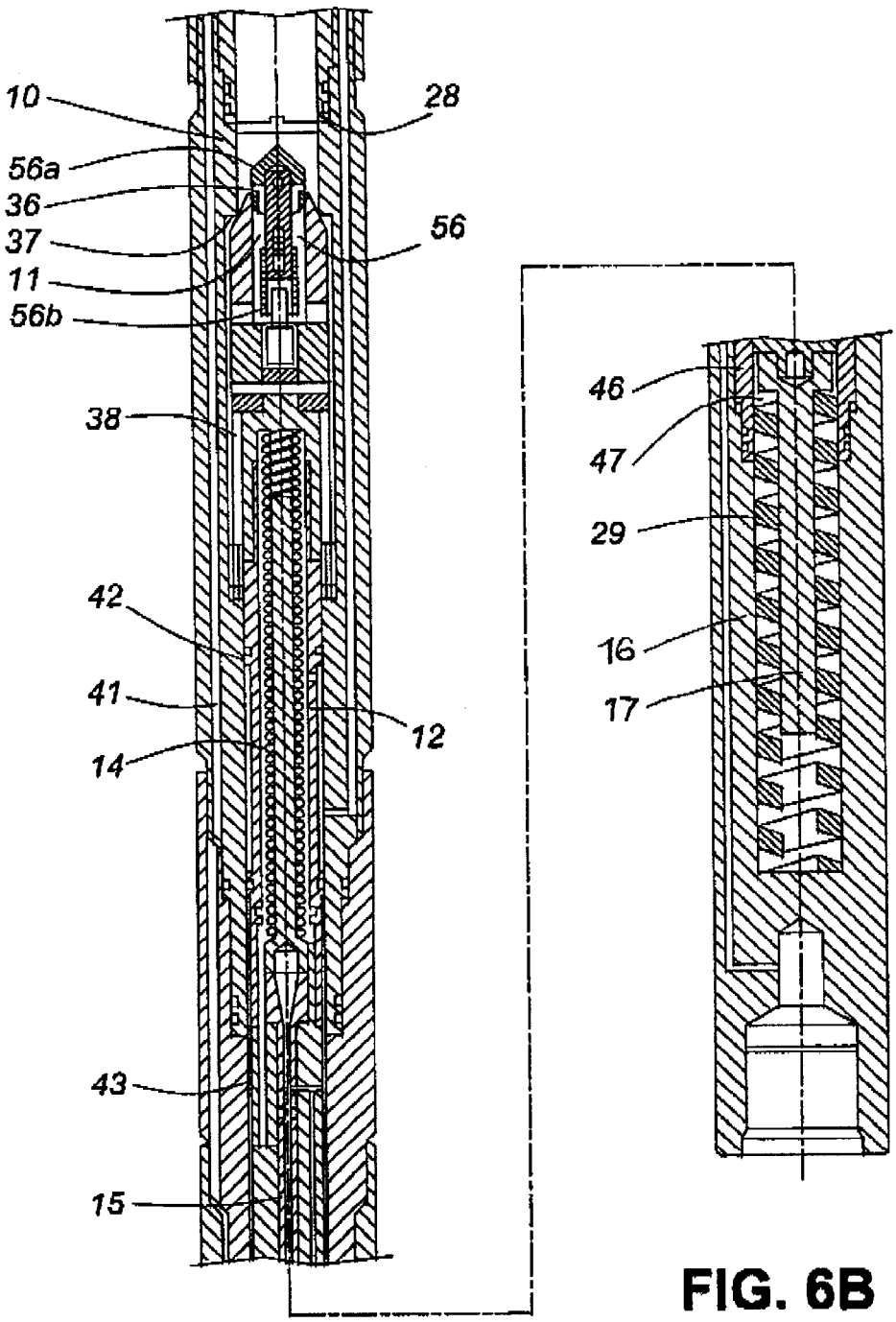
Figure 7A:
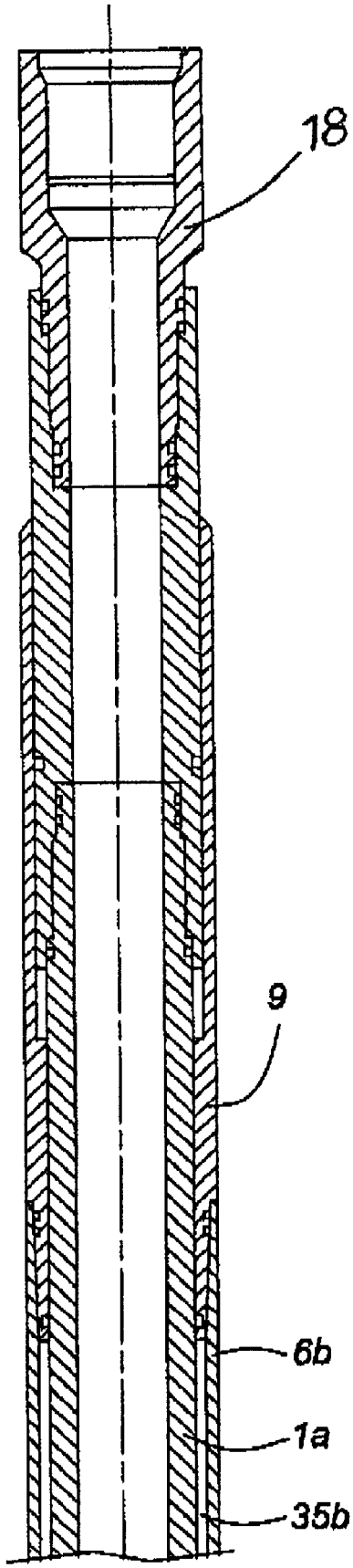
FIGS. 7A and 7B are a detailed assembly drawing of the blast joint, lower packer assembly and power shear assembly, disposed on the lower mandrel of the tool.
Figure 7B:
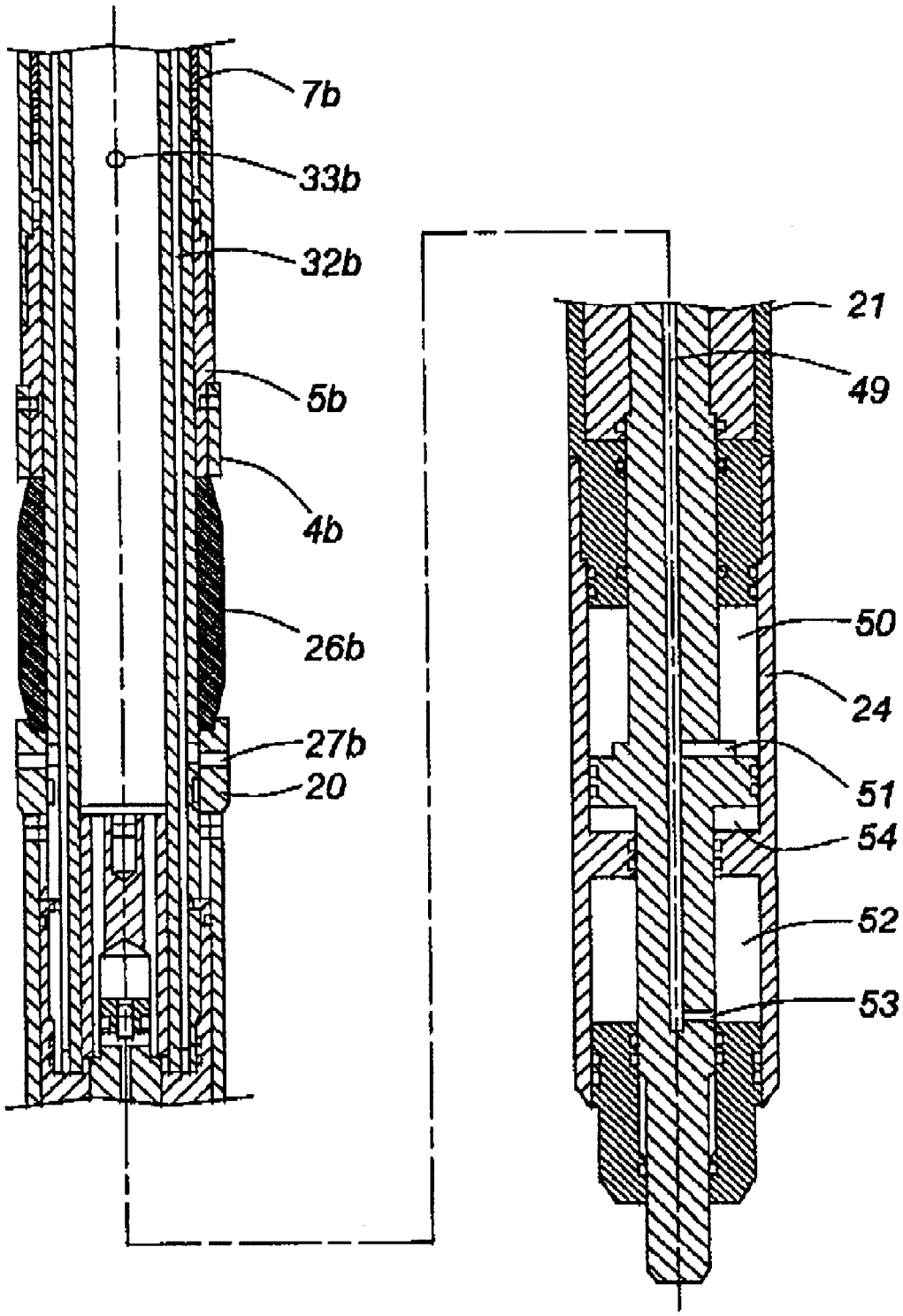
Figure 8:
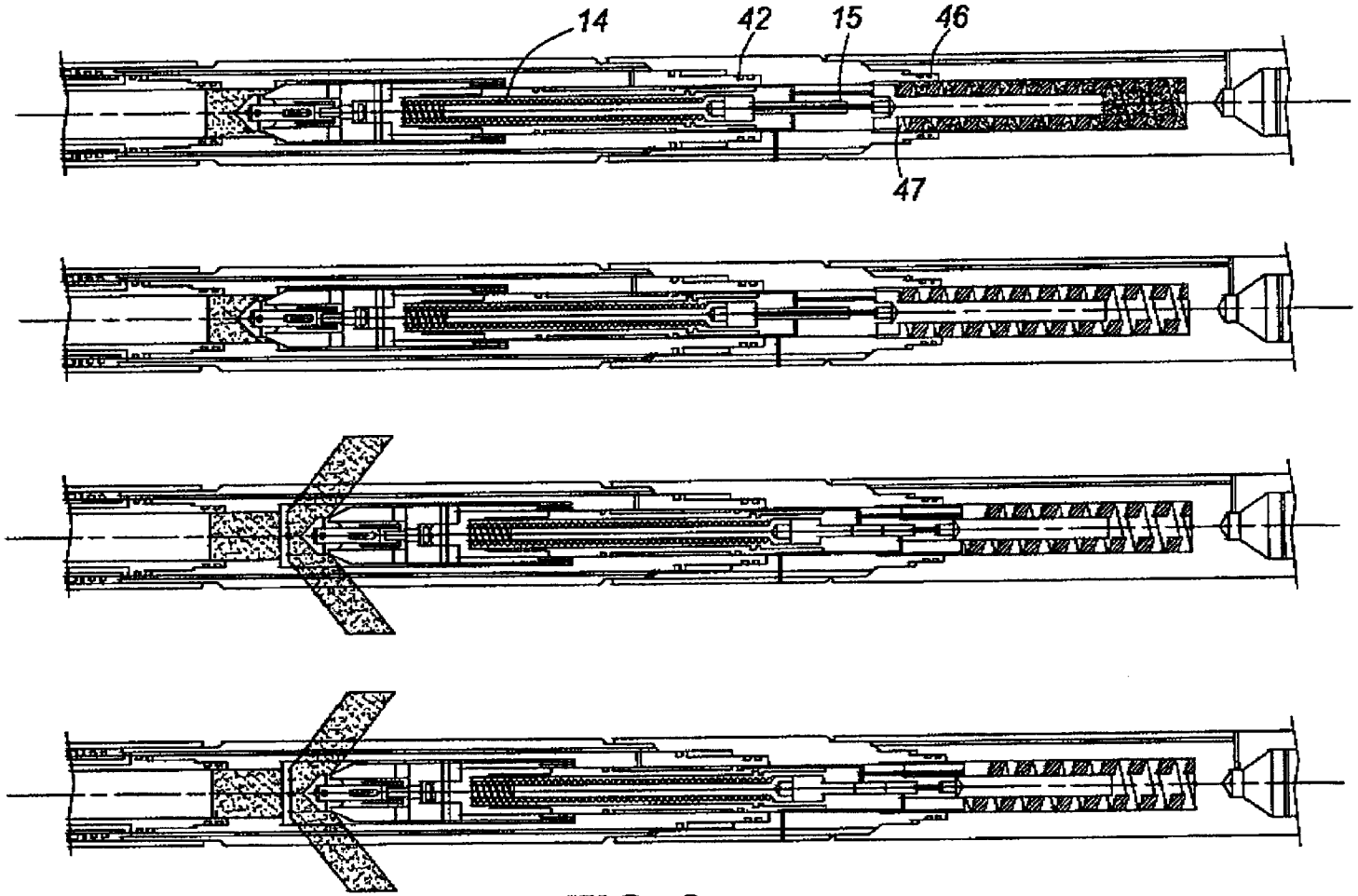
FIG. 8 is a detailed drawing of the valve section of the straddle packer system in the circulation, setting, treating and releasing phases.

The upper and lower packer assemblies 101 and 104 are preferably identical in design as shown in FIG. 6 allowing interchangeability between each assembly for operational and maintenance purposes.

With reference to FIG. 1, the upper and lower packer assemblies include upper and lower sealing elements 26*a*, 26*b* (a and b subscripts used for distinguishing between upper and lower packer assembly components typically constructed from a rubber elastomer having sealing and deformation properties suitable for use at high pressures and temperatures. The upper sealing element 26*a* is installed on a main mandrel 1 and is retained on an upper end of the main mandrel 1 by a top shear ring 3, upper casing adaptor 4*a* and upper piston adaptor 5*a*.

The lower sealing element 26*b* is installed on a separate mandrel 1*a* and is retained by bottom shear ring 20 lower casing adapter 4*b* and lower piston adapter 5*b*.

Increasing the hydraulic pressure within the mandrel 1, 1*a* causes the sealing elements 26*a*, 26*b* between the shear rings 3 and 20, the upper and lower casing adapters 4*a*, 4*b* to compress and expand radially to seal against the well bore (FIG. 3).

The upper hydraulic setting mechanism includes upper piston 7*a*, upper piston barrel 6*a* and upper barrel adapter assembly 8*a* on mandrel 1. The upper piston 7*a* attaches to the mandrel 1 with shear pins.

The lower hydraulic setting mechanism includes lower piston 7*b*, and lower piston barrel 6*b* on mandrel 1*a*. The lower piston 7*b* attaches to the mandrel 1*a* with shear pins.

There are two passages in the mandrel 1, 1*a* including upper and lower low-pressure piston channels 32*a*, 32*b* and upper and lower high pressure piston ports 33*a*, 33*b*. High-pressure piston port 33*a* joins the coiled tubing internal volume 30 with the upper high-pressure piston chamber 34*a* located between the upper piston 7*a* and the upper piston adapter 5*a*.

Low-pressure channel 32*a* joins upper low-pressure piston chamber 35*a* on the other side of the upper piston 7*a* with the wellbore annulus 31 of the upper packer assembly above seal element 26*a* via a shear ring filter 27*a* under the top shear ring 3.

Lower packer assembly 104 has a similar configuration where a lower low-pressure piston channel 32*b* extends through the lower packer assembly 104 from the lower low pressure chamber 35*b* to the lower side of the bottom shear ring 20.

Upper and lower protector sleeves 9*a*, 9*b* protect the outside surface of the mandrel 1 from erosion and damage.

Control Assembly 102

The control assembly 102 generally includes a frac sub assembly 10, a pressure switch housing 12, a return spring 29 and a pressure switch assembly 15 which operatively interact with each other to open frac ports 38 in the frac sub assembly 10 above a hydraulic threshold pressure to enable fracturing treatment of a zone of interest.

The frac sub assembly 10 includes a poppet seat 37 that provides a sealing surface for a poppet 11 and two large frac ports 38. The poppet 11 contains circulation nozzles 36 for enabling a low volume of circulation fluid to flow from inside the mandrel to the annulus during setting. During low Volume circulation, circulation fluid flows through the circulation nozzles 36 and out through ports 36*a* at the base of the poppet. The size of the circulation nozzles 36 is restricted to enable pressure build up for setting the SPS and for high pressure frac operations.

To allow reverse circulation flow, that is from the wellbore annulus to the inside of the mandrel, a check valve assembly 56 is provided. The check valve assembly includes a valve 56*a* normally biased to a closed position by a valve spring 56*b*. During reverse circulation flow, fluid enters ports 36*a* and pushes check valve assembly 56*a* to an open position against the biasing pressure of the valve spring 56*b* which thereby allows higher volumes of circulating fluid to bypass the circulation nozzles 36.

The control assembly 102 further includes high 41 and low 40 pressure channels which direct hydraulic fluid through the control assembly for frac valve operation. The high-pressure valve channel 41 extends between the coiled tubing internal volume 30 of the upper packer assembly 101 (across mandrel filter 28) to the lower packer assembly 104. The high pressure valve channel 41 also communicates with a first high-pressure chamber 43 and a second pressure chamber 47 via a pressure switch 15. The low-pressure frac valve channel 40 is an extension of the low-pressure piston channel 32 and is vented to the wellbore annulus 31 above rubber element 26 Through vent 32*c*.

Overview of the Control Assembly Design and Operation

As indicated above, the control assembly operates to open a valve in the frac sub assembly to enable fracturing treatment of a zone of interest above a hydraulic threshold pressure.

More specifically, the control assembly 102 functions to:

1. Open the frac ports 38 as hydraulic pressure rises above a threshold value;
2. Keep the frac ports 38 open when the hydraulic pressure drops below the threshold value until a lower threshold pressure is reached, and
3. Close the frac ports 38 when the hydraulic pressure drops below the lower threshold pressure.

To accomplish these functions. sub-systems of springs, pistons and hydraulic channels within the control assembly interact to channel hydraulic fluid to different sub-systems depending on the uphole hydraulic pressure. These sub-systems include inter aila a high pressure piston 42, a low pressure piston 46, a return spring 29, a switch return spring 14 and associated hydraulic channels and chambers as will be described in greater detail below. With reference to FIGS. 2, 3, 4, 5, 8 and 10, an overview of the operation of the sub-systems is described with respect to changes in the uphole hydraulic pressure shown as threshold pressures A, B ace, C in FIG. 8.

At a hydraulic pressure below A, fluid is circulated between and through the circulation nozzles and the frac ports are closed.

At hydraulic pressure A, the upper and lower packer elements are set.

At hydraulic pressure B, the hydraulic pressure acting on high pressure piston 42 overcomes the switch return spring which causes the high pressure piston 42 and pressure switch assembly 15 to be displaced. Displacement of the high pressure piston a) directs high pressure hydraulic fluid to the low pressure piston 46 b) closes the high pressure channel to the second high pressure chamber 47 and c) opens a low pressure channel from the second high pressure chamber to vent high pressure hydraulic fluid to the annulus 31. As a result of the venting of high pressure fluid in the second high pressure chamber 47 and the pressure switch assembly 15 being in the open position, the uphole hydraulic pressure overcomes the return spring and the frac ports open.

Above hydraulic pressure B, the uphole hydraulic pressure acting on the low pressure piston maintains the pressure switch assembly 15 in the open position, thus enabling the uphole hydraulic pressure to continue to overcome the return spring.

As the hydraulic pressure drops below pressure B, the low pressure piston maintains the pressure switch assembly 15 in the open position, thus preventing hydraulic fluid from entering the second high pressure chamber 47.

At hydraulic pressure C, the switch return spring overcomes the low pressure piston causing the pressure switch assembly 15 to displace to the closed position As the pressure switch assembly 15 is displaced to the closed position, the high pressure channel is opened and directs high pressure fluid to the second high pressure chamber 47 and simultaneously closes the low pressure channel 32. As a result, hydraulic pressure is balanced on both sides of the poppet 11 and the return spring closes the frac valve.

As the hydraulic pressure drops below threshold pressure A, the upper and lower packer assemblies are un-set.

Figure 2:
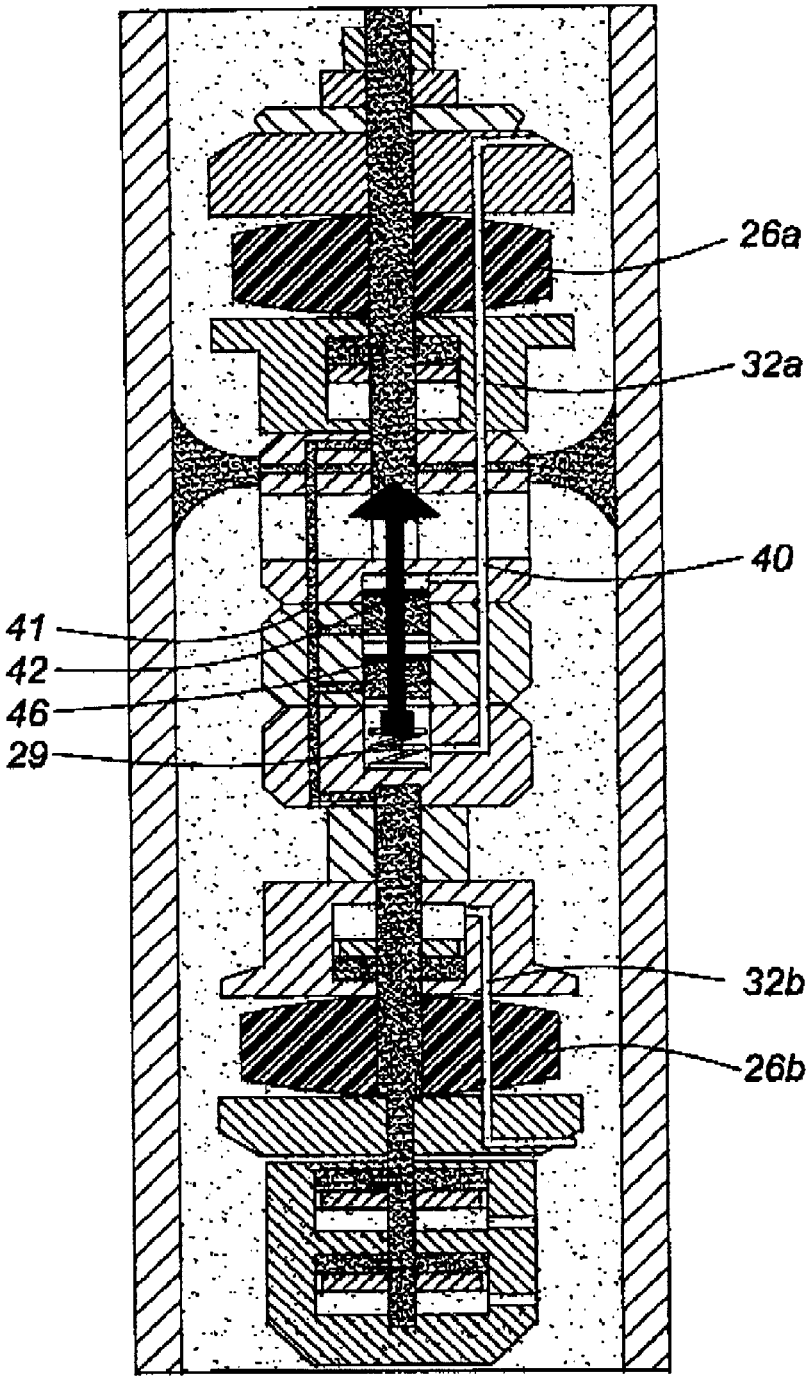
FIG. 2 is a schematic diagram of the straddle packer system in the wash/circulation phase in accordance with the invention.
Figure 10:
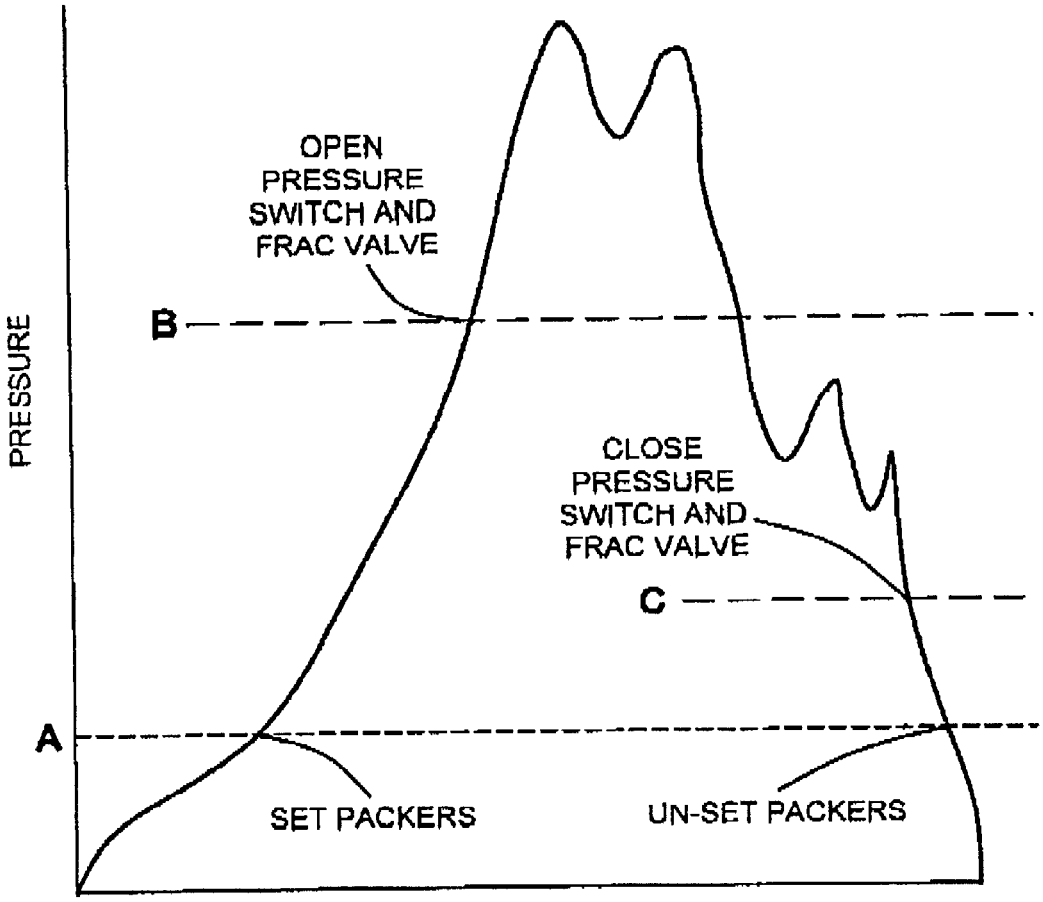
FIG. 10 is a schematic drawing of the effect of various threshold pressures on the operation of the straddle packer system.

Further detail of the operation is now provided. As indicated above, the SPS is lowered to the desired depth typically on the end of the coiled tubing. At this stage the circulation/reverse circulation through the coiled tubing and the SPS is possible at all times (FIG. 2). The top shear ring 3 and the bottom shear ring 20 and the casing adapters 4 provide protection for the seal element 26 while running into or pulling out of the well. Once the packer is positioned as required to isolate the chosen length of the well casing i.e. the proper treatment zone is reached, the SPS is operated as follows:

1. Moderate pumping rates (typically up to 2 bpm) will result in a pressure inside the SPS of up to approximately 1000 psi, and allow a free circulation across the circulation nozzles 36 in the poppet 11 (FIG. 2). Reverse-circulation is not restricted by the circulation nozzles 36 as a result of the check valve assembly 56 incorporated into the poppet 11. Accordingly, a wash treatment or fluid replacement in the well bore may be undertaken prior to the isolating the chosen length of the well casing. While circulating/reverse-circulating, the frac ports 38 are closed by the seal between the poppet 11 and the poppet seat 37 inside the valve assembly 10, 102. The seal between the poppet 11 and the poppet seat 37 inside the valve assembly 10, 102 is maintained at this stage in two simultaneous ways. The preloaded return spring 29 presses the poppet 11 against the poppet seat 37 in the valve sub 10 at the beginning of the pumping or at low pumping rates through the coiled tubing and the SPS.
2. As the pumping rate increases, there is a pressure differential created across the circulating nozzles 36, which in turn increases the pressure inside the coiled tubing and inside the SPS. This increased pressure inside the SPS is passed via high-pressure frac valve channel 41 to the high-pressure frac valve chamber 43 and to the second pressure chamber 47 behind the pressure switch assembly 15. The pressure switch assembly 15 with its seals acts as a pressure balanced piston. Because there is no pressure difference across the pressure switch assembly 15, the preloaded return spring 29 presses the poppet 11 with the pressure switch assembly 15 against the poppet seat 37 independently of what pressure is present in the coiled tubing and SPS. As a result, the seal is maintained, the frac ports 38 remain closed and the pressure build up inside the SPS activates the up-hole and down-hole seal sections. That is, there is a pressure differential across the pistons 7*a,* 7*b* which moves the piston adapters 5*a,* 5*b* towards the rubber elements 26*a,* 26*b*. The rubber elements 26*a,* 26*b* are squeezed between the shear rings 3, 20 and the piston adapters 5*a* 5*b*. As a result, the rubber elements 26*a,* 26*b* expand outward and seal the annulus between the well casing and the SPS mandrel 1 at approximately 1,500 to 1,800 psi (FIG. 3).
3. The frac ports 38 are closed until approximately 2000–2,500 psi of pressure inside the SPS is exceeded. At approximately 2,000–2,500 psi, the force created across the high-pressure piston 42 of the pressure switch 15 exceeds the opposite force of the pressure switch return spring 14. The pressure switch 15 shifts and, as a result, high-pressure inside the pressure chamber 47 is lowered to that of outside the isolated zone 201. The pressure switch 15 by damping pressure from the second pressure chamber 47 through low-pressure frac valve channel 40 causes the shift in the position of the pressure switch housing 12 together with the poppet 11 and opens the frac ports 38. The pressure differential created across the pressure switch assembly 15 compresses the return spring 14. Simultaneously as the pressure switch 15 shifts, the high-pressure is trapped by low-pressure piston 46. The low-pressure piston 46 has a bigger area than the high-pressure piston 42. Thus, pressure in the SPS and in the coiled tubing can drop down below setting pressure of 2000–2,500 psi, as low as 1,000 psi, and the frac ports 38 will remain open. The pressure switch 15 with its two pistons 42 and 46 of different areas allows the system to activate frac ports 38 at 2,500 psi and to remain activated until the pressure drops below 1,000 psi. Thus, the SPS is insensitive to the pressure fluctuations during the treatment (FIG. 10). After the SPS is set, frac treatment of this section of the well bore can proceed as is known by those skilled in the art.
4. Releasing the pressure inside the coiled tubing simultaneously decreases the pressure inside the SPS after the packer is set. A drop in pressure results in pressure equalization across the straddle seal element 26, i.e. the pressure in the straddle zone equalizes to the rest of the well annulus. The sealing/rubber elements 26 are free to come back to the pre-squeezed shape because there is no pressure differential across the pistons 7*a* 7*b*. Also because of the pressure equalization across the pressure switch 15 and the pressure switch housing 12, the return springs 29 and 14 reset the pressure switch 15 and push the pressure switch housing 12 with poppet 11 towards the poppet seat 37 and close the frac ports 38.

Other Features

The SPS has built in several safety mechanisms to enable retrieval from the well bore in case of becoming stuck in the hole or if the maximum allowable treatment pressure is exceeded. Consideration is given to both jamming of the upper and lower packer assemblies.

For the upper packer assembly 101, the force in case of ring 3 is compensated via spacer 2 and by the coiled tubing disconnect 2*a*. The top shear ring 3 is supported from the top via spacer 2 by the collar of the coiled tubing disconnect 2*a* which is rigidly screwed to the top of the SPS. Thus, the top shear ring 3 can be sheared only by pulling the SPS with the coiled tubing upward.

Power Shear Assembly 105

The bottom she ring 20 is supported from the bottom by the power shear assembly 105.

As the pressure inside a set SPS and in the isolated section of the well bore by a set SPS increases, the force exerted on the top shear ring 3 and the bottom shear ring 20 increases as a result of the pressure differential across sealing rubber elements 26*a,* 26*b.*

For the bottom packer assembly 104 and the bottom shear ring 20, the force applied to this shear ring is neutralized by the action of two pistons in the power shear assembly an upper power shear piston 21 and lower power shear piston 24 which together support the bottom shear ring 20. As the pressure inside the SPS during treatment increases, the pressure is passed through power shear high pressure channel 49 to a first high pressure power shear chamber 50 and a second high pressure power shear chamber 52 through upper and lower power shear piston ports 51 and 53. The pressure differential across the power shear upper piston 21 and power shear lower piston 24 supports the bottom shear ring 20 against the combined opposite forces caused by the pressure differential during the treatment across the sealing rubber element 26 and the compressive action of the piston adapter 5. Thus, in this configuration, the shear force at which the top shear ring 3 and the bottom shear ring 20 would be sheared is not affected by the pressures experienced by the SPS during treatment.

This is in contrast to any other presently available straddle packers. These devices require during setting up the shear value at which the shear rings of the tool releases, to take into account not only the strength of the coiled tubing and the depth to which the tool is to be run, but also the effects of high pressures inside the tool during the treatment. The differential pressure across the sealing element (in case of SPS rubber element 26) must be compensated by the shear pins holding the shear ring in place. In this configuration the forces at which the shear rings will be sheared off in the case when the tool is stuck in the well bore are excessive, especially during the treatments, which require high operating pressures. The SPS on the other hand does not require such high shear force value at the shear rings. When the SPS is stuck (after releasing the pressure in the tool) by pulling the coiled tubing up, the top shear ring 3 and the bottom shear ring 20 are easily sheared, which subsequently releases the rubber elements 26 unsetting and freeing the packer. The independence of the shear value to shear of the shear rings 3, 20 from the pressures experienced by the SPS during the treatment allows an operator to preset the shear at minimum reasonable/required values based only on the strength of the coiled tubing and the depth of the attempted treatment in the well bore.

In addition the design of the SPS does not require the tool to be removed from the well bore even if at some point of the treatment in the well bore, the shear rings 3, 20 were sheared off. In the case of the top section of the SPS, an increase in pressure inside the tool results in the movement of the piston adapter 5 upwards. This movement slides the rubber elements 26 and the sheared top shear ring 3 and the spacer 2 up, until the spacer encounters and is supported on the coiled tubing disconnect 2*a.* Since further movement up of the spacer 2 and the top shear ring 3 is not possible, the rubber element 26 is compressed which in turn sets the SPS.

In the case of the bottom section of the SPS, an increase in the pressure in the SPS results in the upward movement of the power shear pistons 21 and 24 and the sheared bottom shear ring 20. Simultaneous downward movement of the piston adapter 5*b* results in the setting of the SPS. Thus, the SPS design enables tool retrieval in the most commonly occurring situations of tool jamming and further enables the SPS to automatically reset without the necessity of the tool retrieval from the well bore, allowing completion of the treatment of the well.

A further safety feature in the SPS is that, by using a specified number and/or type of shear pins in the pistons 7*a,* 7*b* the SPS can be set in such that a predetermined maximum pressure inside the SPS and a maximum allowable treatment pressure will not be exceeded. For example, at the moment when the specified maximum operating pressure during treatment with the SPS is exceeded, the shear pins in pistons 7*a,* 7*b* will shear due to excessive differential pressure across these pistons and the piston adapters 5*a,* 5*b* release compressed rubber elements 26*a,* 26*b,* which in turn will unset the SPS. This feature protects the integrity of the SPS and can be also used to protect treated well bore from exposing it to excessive pressures. In addition shear pins in pistons 7*a,* 7*b* are additional shear points, which can be used to free a stuck tool by pulling the tool up with the coiled tubing.

Further still, the flexibility of the rubber elements 26*a,* 26*b* and the free independent axial movement of casing adapters 6 assist in helping to free a stuck SPS if the coiled tubing is manipulated by pulling and/or pushing.

Although a preferred embodiment of the present invention has been described, those of skill in the art will appreciate that variations and modifications may be made without departing from the spirit of the invention.

What is claimed is:

1. A straddle packer and fracturing treatment system comprising:

upper and lower seal systems having resiliently flexible sealing elements hydraulically and operatively connected to one another, the upper and lower packing systems responsive to an increase in hydraulic pressure for setting the sealing elements at a first hydraulic pressure threshold;

a control system hydraulically and operatively connected between the upper and lower packer systems, the control system responsive to an increase in hydraulic pressure at a second hydraulic pressure threshold higher than the first hydraulic pressure for activating a pressure switch system within the control system for opening at least one frac valve in the control system, the pressure switch system responsive to a third hydraulic pressure threshold between the first and second hydraulic pressure thresholds for closing the at least one frac valve.

2. A system as in claim 1 wherein the control system and pressure switch system include:

a pressure switch operatively retained in the control system, the pressure switch having a first high pressure piston and chamber and a second low pressure piston and chamber, the pressure switch operable between a closed and an open position;

a pressure switch return spring for biasing the pressure switch to a closed position when the hydraulic pressure is below the second hydraulic pressure threshold;

a return spring for biasing the at least one frac valve to a closed position when the hydraulic pressure is below the second hydraulic pressure threshold and the pressure switch is in the closed position;

wherein hydraulic pressure at the second hydraulic pressure threshold acting on the first high pressure piston causes the pressure switch to move to the open position.

3. A system as in claim 2 wherein the pressure switch system further comprises a hydraulic channel operatively connected between the first high pressure piston chamber and second low pressure piston chamber, wherein the hydraulic channel is open when the pressure switch is in the open position.

4. A system as in claim 2 wherein the at least one frac valve is a poppet adapted for seating against a poppet seat and wherein the poppet is operatively connected to the return spring.

5. A system as in claim 2 wherein the first high pressure piston chamber further comprises a second high volume piston chamber and wherein the first high pressure piston chamber is in hydraulic communication with the second high volume piston chamber when the pressure switch is in the closed position and wherein the second high volume piston chamber is vented to the wellbore above the first sealing element when the pressure switch is in the open position and wherein the first high pressure piston chamber and second high volume piston chamber are sealed from one another when the pressure switch is in the open position.

6. A system as in claim 1 adapted for connection to a coiled tubing system for downhole placement and wherein hydraulic fluid for pressurizing the system is delivered through the coiled tubing.

7. A system as in claim 1 wherein the control system includes circulation nozzles in fluid communication between the interior and exterior of the system for allowing a circulating fluid to be run from the interior to the exterior of the system.

8. A system as in claim 7 wherein the control system further comprises a check valve assembly in fluid communication with the at least one frac valve, the check valve assembly for enabling a circulating fluid to flow from the exterior to the interior of the system while bypassing the circulation nozzles.

9. A system as in claim 1 further comprising a power shear assembly operatively and hydraulically connected to the lower seal system for hydraulically pressurizing the lower seal element from the underside of the tower seal system.

10. A system as in claim 1 wherein the first hydraulic pressure threshold is 1000–1200 psi.

11. A system as in claim 1 wherein the second hydraulic pressure threshold is 1700–2500 psi.

12. A system as in claim 1 wherein the third hydraulic pressure threshold is 1200–1500 psi.

13. A system as in claim 1 wherein the control assembly and lower seal assembly are operatively connected through a blast joint, the blast joint of a selective length to enable the system to straddle a zone of interest.

14. A system as in claim 13 wherein the frac valve is positioned uphole of the blast joint and the at least one frac valve orients hydraulic fluid in a downhole direction when the at least one frac valve is open.

15. A method of treating a formation with a straddle packer through a wellbore comprising the steps of:

a) lowering a system as in claim 1 downhole to a zone of interest;

b) increasing pumping pressure to the system to the first hydraulic pressure threshold to seal the upper and lower seal assemblies against the well bore;

c) increasing the pumping pressure to the system to the second hydraulic pressure threshold to open the at least one frac valve;

d) increasing the pumping pressure to the system above the second hydraulic pressure threshold to apply a fracturing treatment to the zone of interest; and e) decreasing the pumping pressure below the third hydraulic pressure threshold to terminate the fracturing treatment.

16. A method as in claim 15 further comprising the step of reducing the pumping pressure to below the first hydraulic pressure threshold to un-seal the upper and lower seal assemblies from the well bore.

* * * * *